US008593490B2

(12) United States Patent
Chen et al.

(10) Patent No.: US 8,593,490 B2
(45) Date of Patent: Nov. 26, 2013

(54) VOLTAGE REGULATION METHOD

(75) Inventors: Ping-Hsien Chen, Pingtung County (TW); Bi-Hsien Chen, Taipei County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 652 days.

(21) Appl. No.: 12/779,950

(22) Filed: May 13, 2010

(65) Prior Publication Data

US 2011/0193849 A1 Aug. 11, 2011

(30) Foreign Application Priority Data

Feb. 9, 2010 (TW) ..... 99103953 A

(51) Int. Cl.
*G09G 5/10* (2006.01)
*G09G 3/36* (2006.01)

(52) U.S. Cl.
USPC ..... 345/690; 345/89

(58) Field of Classification Search
USPC ..... 345/86–100, 690; 348/241
See application file for complete search history.

(56) References Cited

U.S. PATENT DOCUMENTS 5,784,041 A * 7/1998 Okada et al. ..... 345/89
6,831,620 B1 * 12/2004 Nishikubo et al. ..... 345/87
7,173,597 B2 * 2/2007 Kato ..... 345/99
2003/0132905 A1 * 7/2003 Lee et al. ..... 345/89
2005/0162535 A1 * 7/2005 Lee et al. ..... 348/241
2006/0164355 A1 * 7/2006 Kim et al. ..... 345/89
2008/0180375 A1 * 7/2008 Wang ..... 345/89
2009/0262057 A1 * 10/2009 Yoon et al. ..... 345/89

FOREIGN PATENT DOCUMENTS

TW 523731 3/2003
TW 583624 4/2004

OTHER PUBLICATIONS

"Office Action of Taiwan counterpart application" issued on Jun. 7, 2013, p. 1-p. 8, in which the listed reference was cited.

* cited by examiner

*Primary Examiner* — Chanh Nguyen
*Assistant Examiner* — James Nokham
(74) *Attorney, Agent, or Firm* — Jianq Chyun IP Office

(57) ABSTRACT

A voltage regulation method is provided and includes the following steps. A plurality of fixed voltages is provided to a gray-level resistor string, and a plurality of gray-level voltages and the fixed voltages are divided into a first voltage group and a second voltage group according to signal-to-noise ratios of the gray-level values. It is to determine whether the regulated fixed voltage is used to regulate a gray-level voltage corresponding to low gray-level value according to different voltage group. When the regulated fixed voltage is used to regulate the gray-level voltage corresponding to low gray-level value, it is determined whether the fixed voltage is regulated again by measuring a luminance value of a gray-level voltage having higher signal-to-noise ratio.

6 Claims, 4 Drawing Sheets

VOLTAGE REGULATION METHOD

CROSS-REFERENCE TO RELATED APPLICATION

This application claims the priority benefit of Taiwan application serial no. 99103953, filed on Feb. 9, 2010. The entirety of the above-mentioned patent application is hereby incorporated by reference herein and made a part of specification.

BACKGROUND OF THE INVENTION

1. Field of the Invention

The invention relates to a voltage regulation method, and especially to a voltage regulation method of a display panel.

2. Description of Related Art

With regard to the liquid crystal display (LCD) panel, each of the gray-level values corresponds to a luminance value. For example, FIG. 1 is a curve diagram of the gray-level value and the luminance value. As show in FIG. 1, the resolution of the LCD panel is equal to 8-bit such that the LCD panel includes 256 gray-level values GL0~GL255 and 256 corresponding luminance values L0~L255. In addition, while driving practically, the LCD panel uses the gray-level voltages to rotate the liquid crystal to generate the corresponding luminance value. Therefore, as the curve diagram of the gray-level values and the gray-level voltages shown in FIG. 2, each of the gray-level values has a corresponding gray-level voltage.

Generally, since the contrast ratio of the display panel is based on the maximum luminance value L255 and the minimum luminance value L0, the corresponding minimum gray-level voltage VG0 and the maximum gray-level voltage VG255 are usually set to be two independent voltages, and the rest of the gray-level voltages VG1~VG254 are obtained from the divided voltages by the resistor string in the source driver. However, the gray-level voltages VG1~VG254 frequently vary due to the change of the process and the panel characteristic such that the circumstance of the discontinuous gray-level frame occurs on the LCD panel.

In order to deal with the aforementioned problems, the existing voltage regulation method is externally connecting a portion of the connection nodes of the resistor string with a plurality of fixed voltages. Thus, the portion of the gray-level voltages are regulated by external fixed voltages without completely depending on the divided voltages by the resistor string. In addition, the existing voltage regulation method is regulating the fixed voltages by comparing the luminance values as the display panel displays the fixed voltages with the ideal luminance values. However, due to the effect of the leakage light and the noise of the display panel, it is not easy for the optical instrument to measure the exact value of the luminance value corresponding to the low gray-level value. Therefore, the gray-level voltages generated by the resistor string vary significantly such that the display quality of the display panel is affected. The aforementioned problem may be handled by adding external fixed voltages to reform the variation of the gray-level voltages, but the hardware cost of the display panel may be increased. Therefore, it is an important topic of designing the LCD panel nowadays to effectively regulate the gray-level voltages in consideration of the hardware cost.

SUMMARY OF THE INVENTION

The invention provides a voltage regulation method to prevent the problem of the optical instrument being hard to measure the low gray-level luminance value when the low gray-level luminance value varies.

The invention provides a voltage regulation method for regulating a plurality of gray-level voltages provided by a gray-level resistor string in a display panel. Wherein the gray-level voltages corresponds to a plurality of gray-level values. The voltage regulation method includes the following steps. First, a plurality of fixed voltages are provided to a gray-level resistor string. The plurality of gray-level voltages and the plurality of fixed voltages are divided into a first voltage group and a second voltage group according to signal-to-noise ratios of the gray-level values. Wherein, the first voltage group includes a portion of the gray-level voltages and a portion of the fixed voltages and the second voltage group includes the rest of the gray-level voltages and the rest of the fixed voltages. Moreover, one fixed voltage is selected from the fixed voltages to be a specific fixed voltage. The voltage level of the specific fixed voltage is regulated. Next, whether the specific fixed voltage is divided into the first voltage group is determined.

When the specific fixed voltage is divided into the first voltage group, one gray-level voltage is selected from the gray-level voltages in the second voltage group to be a replacement gray-level voltage, and whether to re-regulate the voltage level of the specific fixed voltage is determined by measuring a luminance value as the display panel displays the replacement gray-level voltage. On the contrary, when the specific fixed voltage is not divided into the first voltage group, whether to re-regulate the voltage level of the specific fixed voltage is determined by measuring the luminance value as the display panel displays the specific fixed gray-level voltage. In addition, the specific fixed voltage is re-selected until the fixed voltages are sequentially regulated.

According to an embodiment of the invention, the aforementioned step of dividing the gray-level voltages and the fixed voltages into the first voltage group and the second voltage group according to signal-to-noise ratios of the gray-level values includes: calculating a plurality of ideal luminance values corresponding to the gray-level values; calculating a plurality of signal-to-noise ratios of the gray-level values with the ideal luminance values corresponding to the gray-level values, and dividing the gray-level values into a plurality of low signal-to-noise ratio gray-level values and a plurality of high signal-to-noise ratio gray-level values according to a threshold; setting the gray-level values and the fixed voltages corresponding to the low signal-to-noise ratio gray-level values to be the first voltage group; and setting the gray-level values and the fixed voltages corresponding to the high signal-to-noise ratio gray-level values to be the second voltage group.

According to an embodiment of the invention, the aforementioned voltage regulation method further comprises: electrically connecting the gray-level resistor string with one end of a external resistor, and the other end of the external resistor providing a minimum gray-level voltage corresponding to the display panel. In addition, the aforementioned step of providing the fixed voltages to the gray-level resistor string comprises receiving one of the fixed voltages via the other end of the external resistor.

As described above, the plurality of gray-level voltages and the plurality of fixed voltages are divided into two voltage groups according to signal-to-noise ratios of the gray-level values. Accordingly, it is determined whether the regulated fixed voltage is used to regulate the gray-level voltage nearby the low gray-level value. When the regulated fixed voltage is used to regulate the gray-level voltage corresponding to low gray-level value, it is determined whether the fixed voltage is regulated again by measuring the luminance value of a gray-level voltage having higher signal-to-noise ratio. Therefore, the problem of the optical instrument being hard to measure the low gray-level luminance value as the low gray-level luminance value varies may be prevented. On the other hand, comparing with the existing technology, the invention effectively regulates the gray-level voltages without increasing the hardware cost of the display panel.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
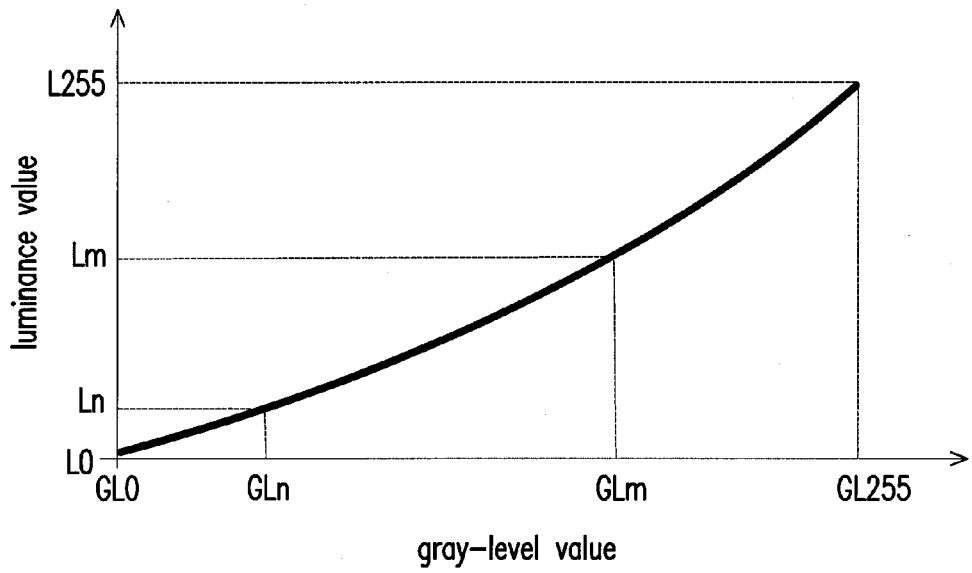
FIG. 1 (Related Art)
FIG. 1 is a curve diagram of the gray-level value and the luminance value of the prior art.
Figure 2:
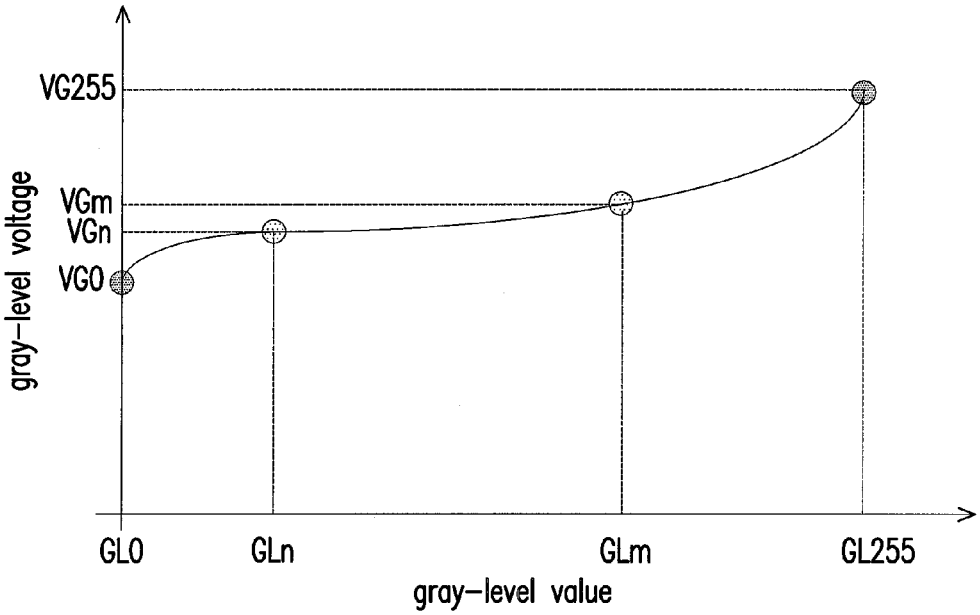
FIG. 2 (Related Art)
FIG. 2 is a curve diagram of the gray-level value and the gray-level voltage of the prior art.
Figure 3:
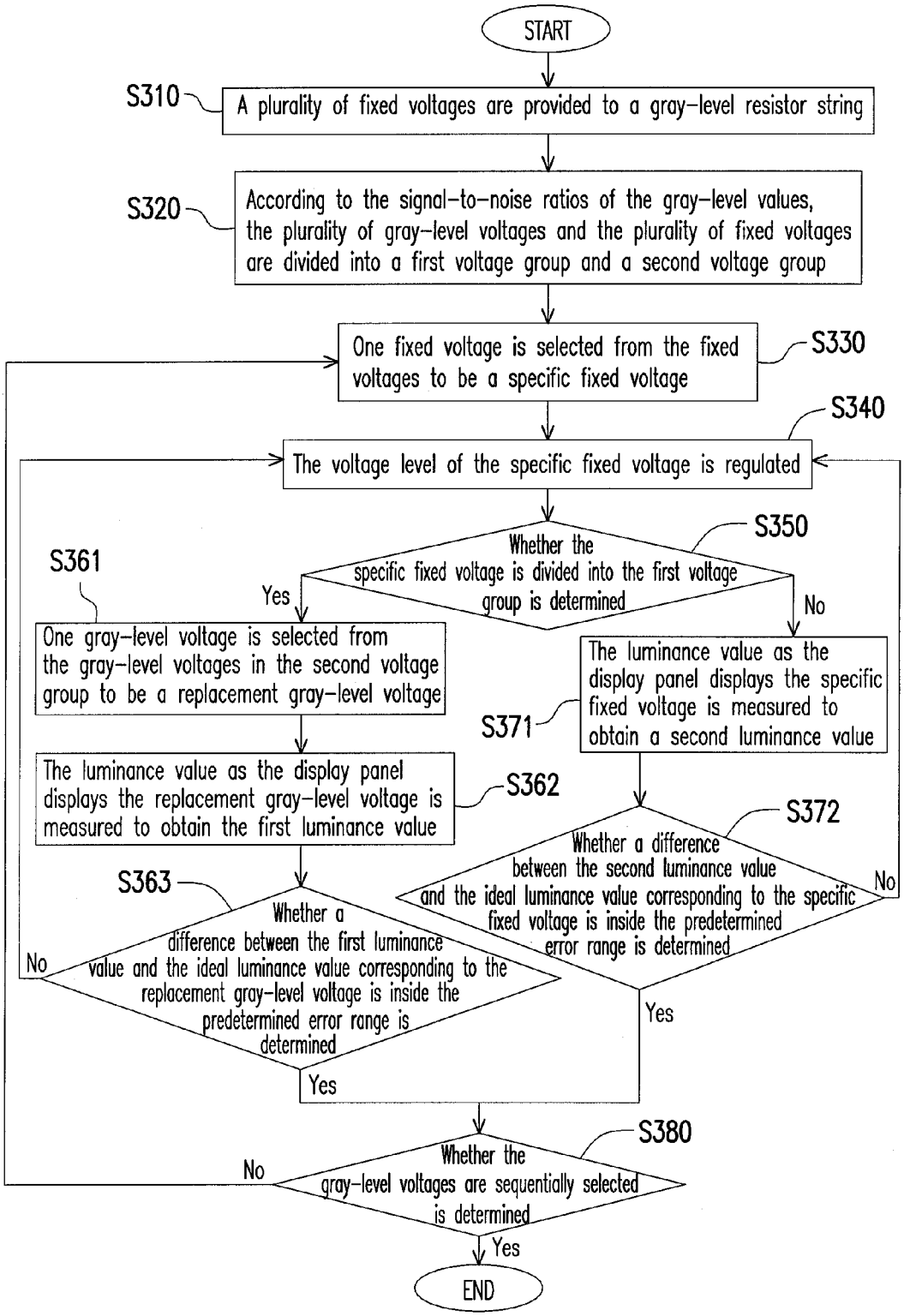
FIG. 3 shows a flowchart of the voltage regulation method according to an embodiment of the invention.
Figure 4:
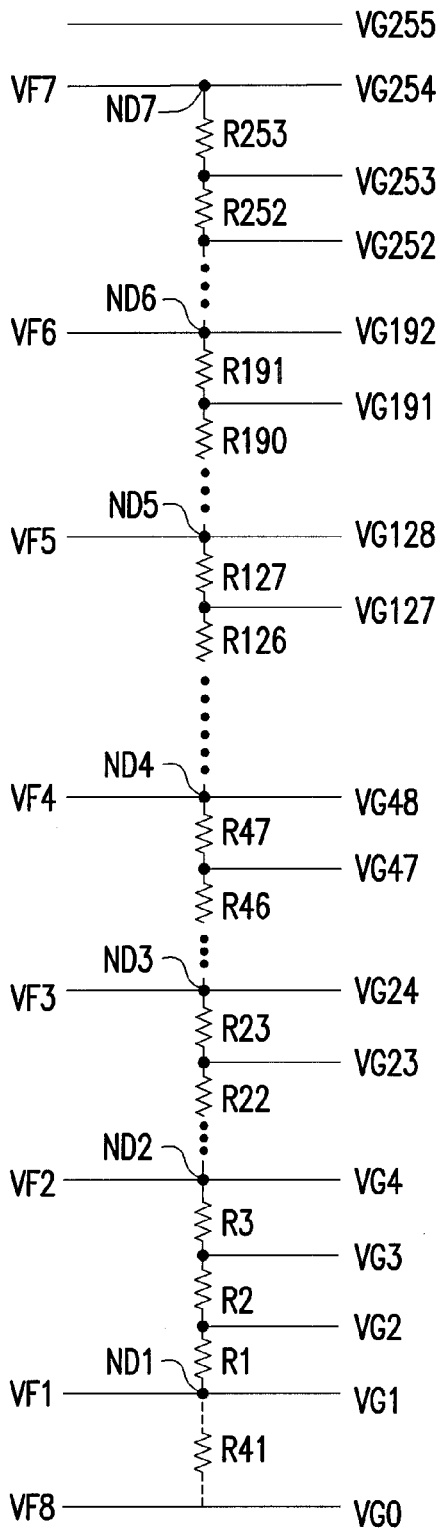
FIG. 4 shows a schematic of illustrating the gray-level resistor string in FIG. 1.

FIG. 3 shows a flowchart of the voltage regulation method according to an embodiment of the invention. Wherein the voltage regulation method regulates a plurality of gray-level voltages provided by a gray-level resistor string in a display panel. In order to make the embodiment to be easily understood by those with ordinary skill in the art, FIG. 4 shows a schematic of illustrating the gray-level resistor string in FIG. 1. Assuming the resolution of the display panel is 8-bit herein, as shown in FIG. 4, the minimum gray-level voltage VG0 and the maximum gray-level voltage VG255 are set independently in the display panel. Moreover, the gray-level resistor string is formed by stringing the resistors R1~R253 to generate the gray-level voltages VG1~VG254.

Referring to FIG. 3, regarding the regulation of the gray-level voltages VG1~VG254, at first, in the step S310, a plurality of fixed voltages are provided to a gray-level resistor string. For example, as shown in FIG. 4, the fixed voltages VF1~VF7 are provided to the connection nodes ND1~ND7 of the gray-level resistor string. Thus, the gray-level voltages VG1, VG4, VG24, VG48, VG128, VG192, VG254 may be determined by the fixed voltages VF1~VF7, that is to say, the fixed voltages VF1~VF7 are equal to the gray-level voltages required by the display panel. In addition, the rest of the gray-level voltages are determined by the divided voltages of the resistors between two fixed voltages.

It is noted that each of the gray-level voltages has a corresponding gray-level value. Hence, in the step S320, according to the signal-to-noise ratios (SNR) of the gray-level values, the plurality of gray-level voltages and the plurality of fixed voltages are divided into a first voltage group and a second voltage group. Regarding the detailed steps of the step S320, when the gray-level voltages VG1~VG254 corresponds to the gray-level values GL1~GL254, at this time, the ideal luminance values corresponding to the gray-level values GL1~GL254 are calculated first. Then, the signal-to-noise ratios of the gray-level values GL1~GL254 are calculated with the ideal luminance values corresponding to the gray-level values GL1~GL254.

For example, Equation (1) is the transforming equation of the ideal luminance values. After the maximum gray-level value $GL_{max}$ and the maximum ideal luminance value $L_{max}$ are set, the ideal luminance values may be calculated according to Equation (1).

$$L_i = L_{max}\left(\frac{GL_i}{GL_{max}}\right)^{\gamma} \qquad \text{Equation (1)}$$

wherein, γ is the gamma value, $GL_i$ stands for the $i^{th}$ gray-level value, $L_i$ stands for the $i^{th}$ ideal luminance value, and i is the integer and is greater or equal to zero.

In addition, when the minimum gray-level value GL0 corresponding to the display panel is set to be a predetermined gray-level value, the ideal luminance values corresponding to the gray-level values GL1~GL254 are divided by the ideal luminance value of the predetermined gray-level value to obtain each of the SNRs of the gray-level values GL1~GL254. For example, as shown in Table (1), the ideal luminance values corresponding to the gray-level values are listed, wherein the ideal luminance value of the minimum gray-level value GL0 is 0.25. Therefore, the ideal luminance values of each of the gray-level values are divided by the ideal luminance value of the minimum gray-level value GL0 such that the SNR of the gray-level value GL4 is 0.36/0.25=1.44. Similarly, the SNR of the gray-level value GL16 is 0.93/0.25=3.72. The SNRs of the rest of the gray-level values maybe obtained by analogy.

TABLE (1)

| gray-level value | ideal luminance value | SNR |
|---|---|---|
| GL0 | 0.25 | 1.00 |
| GL1 | 0.28 | 1.12 |
| GL4 | 0.36 | 1.44 |
| GL8 | 0.47 | 1.88 |
| GL11 | 0.55 | 2.20 |
| GL12 | 0.61 | 2.44 |
| GL16 | 0.93 | 3.72 |
| GL20 | 1.36 | 5.44 |
| GL24 | 1.91 | 7.64 |
| GL28 | 2.57 | 10.28 |
| GL32 | 3.37 | 13.48 |
| GL64 | 14.57 | 58.28 |
| GL128 | 66.05 | 264.20 |
| GL192 | 160.81 | 643.24 |
| GL255 | 300.00 | 1200.00 |

Next, based on a threshold, the magnitude of the SNR is determined to divide the gray-level values GL1~GL254. For example, when the threshold is 58.3, the SNR (7.64) corresponding to the gray-level value GL24 is less than the threshold (58.3) such that the gray-level value GL24 is divided into the low SNR gray-level value. On the contrary, the SNR (264.20) corresponding to the gray-level value GL128 is greater than the threshold (58.3) such that the gray-level value GL128 is divided into the high SNR gray-level value. Similarly, based on the threshold (58.3), the gray-level values GL1~GL254 are divided into the low SNR gray-level values GL1~GL64 and the high SNR gray-level values GL65~GL254. In addition, the gray-level voltages VG1~VG64 and the fixed voltages VF1~VF4 corresponding to the low SNR gray-level values GL1~GL64 are set to be the first voltage group. The gray-level voltages VG65~VG254 and the fixed voltages VF5~VF7 corresponding to the high SNR gray-level values GL65~GL254 are set to be the second voltage group.

Referring to FIG. 3, after the first voltage group and the second voltage group are determined, in the step S330, one fixed voltage is selected from the fixed voltages to be a specific fixed voltage. For example, VF1 is selected from the fixed voltages VF1~VF7 to be the specific fixed voltage. Then, in the step S340, the voltage level of the specific fixed voltage is regulated, and in the step S350, whether the specific fixed voltage is divided into the first voltage group is determined.

When the specific fixed voltage is divided into the first voltage group, in the step S361, one gray-level voltage is selected from the gray-level voltages in the second voltage group to be a replacement gray-level voltage, and in the step S362, the luminance value as the display panel displays the replacement gray-level voltage is measured to obtain the first luminance value. Then, through the step S363, whether a difference between the first luminance value and the ideal luminance value corresponding to the replacement gray-level voltage is inside the predetermined error range is determined to decide whether to re-regulate the voltage level of the specific fixed voltage.

For example, when VF1 is selected to be the specific fixed voltage, since the specific fixed voltage VF1 is divided into the first voltage group, that is to say, the specific fixed voltage VF1 corresponds to the low SNR gray-level value. The optical instrument may not accurately measure the corresponding luminance value. Therefore, at this time, one gray-level voltage such as VG128 is selected from the gray-level voltages VG65~VG254 in the second voltage group to be a replacement gray-level voltage. Then, the first luminance value as the display panel displays the replacement gray-level voltage VG128 is measured, and the first luminance value is compared with the ideal luminance value (66.05) corresponding to the replacement gray-level voltage VG128. When the difference between the first luminance value and the ideal luminance value (66.05) is not inside the predetermined error range, the method returns to the step S340 to re-regulate the voltage level of the specific fixed voltage VF1. On the contrary, when the difference between the first luminance value and the ideal luminance value (66.05) is inside the predetermined error range, the method returns to the step S380 to regulate the rest of the fixed voltages.

On the other hand, when the specific fixed voltage is not divided into the first voltage group, in the step S371, the luminance value as the display panel displays the specific fixed voltage is measured to obtain a second luminance value. Then, in the step S372, whether a difference between the second luminance value and the ideal luminance value corresponding to the specific fixed voltage is inside the predetermined error range is determined to decide whether to re-regulate the voltage level of the specific fixed voltage.

For example, when VF6 is selected to be the specific fixed voltage, since the specific fixed voltage VF6 is divided into the second voltage group, that is to say, the specific fixed voltage VF6 corresponds to the high SNR gray-level value. The optical instrument may accurately measure the corresponding luminance value. Then, the second luminance value as the display panel displays the specific fixed voltage VF6 is measured directly, and the second luminance value is compared with the ideal luminance value (160.81) corresponding to the specific fixed voltage VF6. When the difference between the second luminance value and the ideal luminance value (160.81) is not inside the predetermined error range, the method returns to the step S340 to re-regulate the voltage level of the specific fixed voltage VF6. On the contrary, when the difference between the second luminance value and the ideal luminance value (160.81) is inside the predetermined error range, the method returns to the step S380 to regulate the rest of the fixed voltages.

In order to ensure that each of the fixed voltages can be sequentially regulated, in the step S380, whether the fixed voltages are sequentially selected is determined. When the fixed voltages are not sequentially selected, the method returns to the step S330 to select the rest of the fixed voltages to be the specific fixed voltage. On the contrary, when the fixed voltages are sequentially selected, it represents that the fixed voltages are sequentially regulated such that the regulation of the fixed voltages ends. In other words, the specific fixed voltage is continuously re-selected until the fixed voltages are sequentially regulated.

Figure 5:
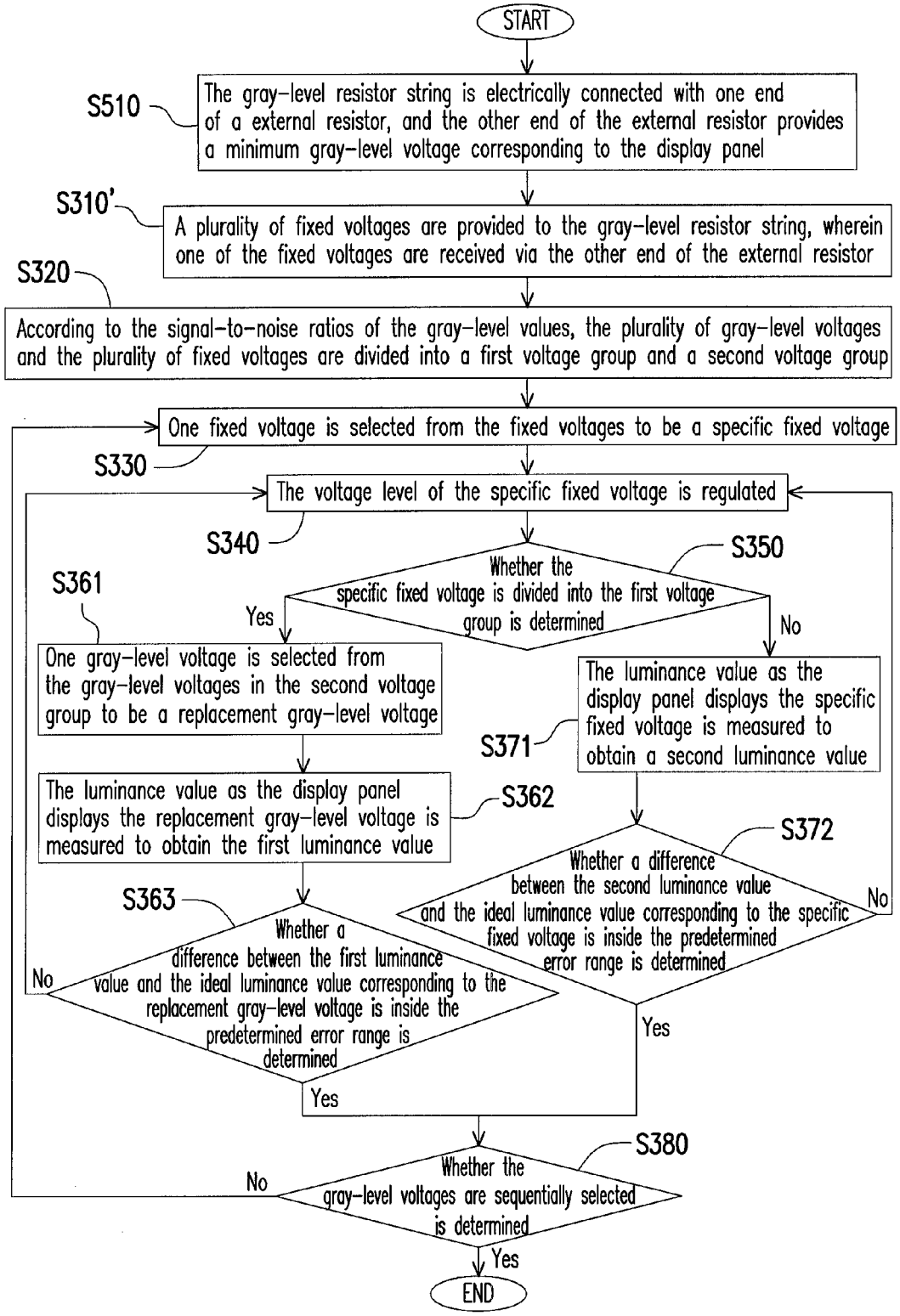
FIG. 5 shows a flowchart of the voltage regulation method according to an embodiment of the invention.

It is noted that the minimum gray-level voltage independently set in the display panel is regulated in the way similar to the voltage regulation method in FIG. 3. For example, FIG. 5 shows a voltage regulation method according to another embodiment of the invention. Referring to FIG. 3 and FIG. 5, the major difference between the two embodiments is that the embodiment in FIG. 5 further includes the step S510 and the detailed step of the step S310' is different from the step S310 in FIG. 3.

To be more specific, in the embodiment in FIG. 5, through the step S510, the gray-level resistor string is electrically connected with one end of an external resistor, and the other end of the external resistor provides a minimum gray-level voltage corresponding to the display panel. For example, as shown in FIG. 4, one end of the external resistor R41 is electrically connected with the gray-level resistor string, and the other end of the external resistor R41 provides the minimum gray-level voltage VG0. In the step S310', a plurality of fixed voltages are provided to the gray-level resistor string. It is noted that one of the fixed voltages are received via the other end of the external resistor. For example, as shown in FIG. 4, in the embodiment in FIG. 5, in addition to the connection nodes ND1~ND7 providing the fixed voltages VF1~VF7 to the gray-level resistor string, the other end of the external resistor R41 is used to provide the fixed voltage VF8 to the gray-level resistor string. Accordingly, the fixed voltage VF8 may be used for regulating the minimum gray-level voltage VG0.

In addition, through the step S320, the fixed voltage VF8 is divided into the first voltage group. Next, when VF8 is selected to be the specific fixed voltage in the step S330, the specific fixed voltage VF8 is regulated in the step S340, and the steps S361~S363 are performed by the determination in the step S340. Accordingly, in the steps S361~S363, one the gray-level voltage is selected from the gray-level voltages in the second voltage group to be the replacement gray-level voltage, and whether to re-regulate the voltage level of the specific fixed voltage VF8 is determined by measuring a luminance value as the display panel displays the replacement gray-level voltage. Thus, the minimum gray-level voltage VG0 is accurately regulated by the fixed voltage VF8. The detailed operation of each of the steps in the embodiment in FIG. 5 is similar to that in the embodiments in FIG. 3 and is not repeated herein.

In summary, the invention divides a plurality of fixed voltages and a plurality of gray-level voltages into two voltage groups according to the SNRs of the gray-level values. Accordingly, when the fixed voltage to be regulated is divided into the first voltage group, it represents that the fixed voltage is used for regulating the gray-level voltages nearby the low gray-level value. Therefore, one gray-level voltage is selected from the gray-level voltages in the second voltage group to be the basis of the measurement. Whether to re-regulate the specific fixed voltage is determined by measuring the luminance value of the gray-level voltage having higher SNR. Thus, the problem of the optical instrument being hard to measure the low gray-level luminance value as the low gray-level luminance value varies may be prevented. Furthermore, the gray-level voltages are effectively regulated without increasing the hardware cost of the display panel.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A voltage regulation method, for regulating a plurality of gray-level voltages provided by a gray-level resistor string in a display panel, the gray-level voltages corresponding to a plurality of gray-level values, the voltage regulation method comprising:

providing a plurality of fixed voltages to the gray-level resistor string;

dividing the plurality of gray-level voltages and the plurality of fixed voltages into a first voltage group and a second voltage group according to signal-to-noise ratios of the gray-level values, wherein the first voltage group includes a portion of the gray-level voltages and a portion of the fixed voltages, and the second voltage group includes the remaining gray-level voltages and the remaining fixed voltages;

selecting one of the fixed voltages to be a specific fixed voltage;

regulating a voltage level of the specific fixed voltage;

determining whether the specific fixed voltage is divided into the first voltage group;

when the specific fixed voltage is divided into the first voltage group, measuring a first luminance value as the display panel displays one of the gray-level voltages in the second voltage group and determining whether to re-regulate the voltage level of the specific fixed voltage according to the first luminance value;

when the specific fixed voltage is not divided into the first voltage group, measuring a second luminance value as the display panel displays the specific fixed voltage and determining whether to re-regulate the voltage level of the specific fixed voltage according to the second luminance value; and re-selecting the specific fixed voltage until the fixed voltages are sequentially regulated, wherein the step of determining whether to re-regulate the voltage level of the specific fixed voltage according to the first luminance value comprises:

determining whether a first difference between the first luminance value and a first ideal luminance value corresponding to the one of the gray-level voltages in the second voltage group is inside a predetermined error range;

when the first difference between the first luminance value and the first ideal luminance value is not inside the predetermined error range, re-regulating the voltage level of the specific fixed voltage; and when the first difference between the first luminance value and the first ideal luminance value is inside the predetermined error range, returning to the step of re-selecting the specific fixed voltage until the fixed voltages are sequentially regulated.

2. The voltage regulation method of claim 1, wherein the step of dividing the gray-level voltages and the fixed voltages into the first voltage group and the second voltage group according to the signal-to-noise ratios of the gray-level values comprises:

calculating a plurality of second ideal luminance values corresponding to the gray-level values;

calculating the signal-to-noise ratios of the gray-level values according to the second ideal luminance values corresponding to the gray-level values, and dividing the gray-level values into a plurality of low signal-to-noise ratio gray-level values and a plurality of high signal-to-noise ratio gray-level values according to a threshold;

setting the gray-level values and the fixed voltages corresponding to the low signal-to-noise ratio gray-level values to be the first voltage group; and setting the gray-level values and the fixed voltages corresponding to the high signal-to-noise ratio gray-level values to be the second voltage group.

3. The voltage regulation method of claim 2, wherein the step of calculating the signal-to-noise ratios of the gray-level values according to the second ideal luminance values corresponding to the gray-level values comprises:

setting a minimum gray-level value corresponding to the display panel to be a predetermined gray-level value; and respectively dividing the second ideal luminance values corresponding to the gray-level values by a third ideal luminance value corresponding to the predetermined gray-level value to obtain the signal-to-noise ratios of the gray-level values.

4. The voltage regulation method of claim 1, wherein the step of determining whether to re-regulate the voltage level of the specific fixed voltage according to the second luminance value comprises:

determining a second difference between the second luminance value and a second ideal luminance value corresponding to the specific fixed voltage is inside the predetermined error range;

when the second difference between the second luminance value and the second ideal luminance value corresponding to the specific fixed voltage is not inside the predetermined error range, re-regulating the voltage level of the specific fixed voltage; and when the second difference between the second luminance value and the second ideal luminance value corresponding to the specific fixed voltage is inside the predetermined error range, returning to the step of re-selecting the specific fixed voltage until the fixed voltages are sequentially regulated.

5. The voltage regulation method of claim 1, wherein the step of re-selecting the specific fixed voltage until the fixed voltages are sequentially regulated comprises:

determining whether the fixed voltages are sequentially selected;

when the fixed voltages are not sequentially selected, returning to the step of selecting one of the fixed voltages to be the specific fixed voltage; and when the fixed voltages are sequentially selected, completing a regulation of the fixed voltages.

6. The voltage regulation method of claim 1, further comprising:

electrically connecting the gray-level resistor string with one end of an external resistor, and an other end of the external resistor providing a minimum gray-level voltage corresponding to the display panel, wherein the step of providing the fixed voltages to the gray-level resistor string comprises receiving one of the fixed voltages via the other end of the external resistor.

* * * * *